US006178883B1

(12) United States Patent
Satoh et al.

(10) Patent No.: US 6,178,883 B1
(45) **Date of Patent: *Jan. 30, 2001**

(54) TOWER TYPE MULTI-COLOR PRINTING PRESS

(75) Inventors: Masayoshi Satoh, Kanagawa; Yuko Tomita, Tokyo, both of (JP)

(73) Assignee: Kabushiki Kaisha Tokyo Kikai, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/158,514

(22) Filed: Sep. 22, 1998

(30) Foreign Application Priority Data

Nov. 26, 1997 (JP) ..... P9-324276

(51) Int. Cl.[7] ..... B41F 5/08
(52) U.S. Cl. ..... 101/220; 101/424.1
(58) Field of Search ..... 101/220, 487, 101/488, 424, 178, 179

(56) References Cited

U.S. PATENT DOCUMENTS

| | | | | |
|---|---|---|---|---|
| 1,834,147 | * | 12/1931 | Dausmann | 101/424.1 |
| 3,952,119 | * | 4/1976 | Buhler | 101/488 |
| 4,697,515 | * | 10/1987 | Germann | 101/179 |
| 5,115,741 | * | 5/1992 | Rodi | 101/424.1 |
| 5,284,090 | * | 2/1994 | Okamura et al. | 101/179 |
| 5,564,336 | * | 10/1996 | Straubinger et al. | 101/424.1 |
| 5,606,914 | * | 3/1997 | Borgardt | 101/424.1 |
| 5,727,472 | * | 3/1998 | Burgio | 101/424.1 |
| 5,832,833 | * | 11/1998 | Burgio | 101/487 |

FOREIGN PATENT DOCUMENTS

| | | | | |
|---|---|---|---|---|
| 0359720 | * | 3/1962 | (CH) | 101/424.1 |
| 3335235 | * | 4/1985 | (DE) | 101/179 |
| 7-285213 | | 10/1995 | (JP) . | |
| 8-66997 | | 3/1996 | (JP) . | |
| 8-230138 | | 9/1996 | (JP) . | |

* cited by examiner

*Primary Examiner*—Ren Yan
*Assistant Examiner*—Anthony H. Nguyen
(74) *Attorney, Agent, or Firm*—Arent Fox Kintner Plotkin Kahn

(57) ABSTRACT

A tower type multi-color printing press has heating means which is constructed in compact and simple in structure to require lesser space for installation, to lower production cost, to facilitate inspection and maintenance and to reduce frequency of occurrence of failure. The tower type multi-color printing press includes a plurality of printing sections provided with stacking in vertical direction, and heating means provided on downstream side of each printing section and extending in a width direction of a paper web fed through a path across each printing section, for heating a printed surface of the paper web every time completing the printing in each printing section.

1 Claim, 6 Drawing Sheets

TOWER TYPE MULTI-COLOR PRINTING PRESS

BACKGROUND OF THE INVENTION

1. Field of the Invention

The present invention relates generally to a tower type multi-color printing press, in which a plurality of printing sections are stacked vertically and a paper web is passed through the printing sections in sequential order to print images on the paper web by the respective printing sections. More specifically, the invention relates to a tower type multi-color printing press having heating means for heating a printed image.

2. Description of the Related Art

A tower type multi-color printing press having means for drying a printed paper has been disclosed in Japanese Unexamined Patent Publication Nos. Heisei 7-285213, 8-66997 and 8-230138, for example.

Each the tower type multi-color printing press disclosed in these publications is provided with heating means or heating means and cooling means at a downstream position passed through all printing sections in a direction of feeding a paper web for drying a printed image after completion of printing by the respective printing sections.

The heating means is not clearly disclosed in Japanese Unexamined Patent Publication Nos. 7-285213 and 8-230138. However, if there are no indication of a special printing, such as printing using a UV ink and if no particular drying function is not clearly disclosed, it is typical to interpret that an apparatus disclosed as drying means for these publications is a heating means.

On the other hand, as a drying function of the ink printed on a paper surface, in addition to a drying function for evaporating a solvent by heating the ink and solidifying a thermoplastic material contained in the ink by cooling the ink, there is another well known drying function by penetrating a liquid component of the ink having high flowability in a paper fiber to leave solid component on the paper surface.

In the inventions disclosed in the foregoing publications, it is required to evaporate the solvent from a printed image after completion of printing by the respective printing sections, namely, in a relative thick ink layer, in which a plurality of inks are overlaid. Accordingly, it is required to elevate the entire thick ink layer in a short period. Also, in order to sufficiently evaporate the solvent from the entire thick ink layer, it is required to maintain high temperature for a relatively long period. Accordingly, a large heat amount is necessary. Also, in order to maintain high temperature over a relatively long period, the heating means inherently becomes quite bulky to the extent to be larger than a printing unit in the respective printing sections to require quite a large installation space. Furthermore, a mechanism inherently becomes quite complicated.

On the other hand, as heating means, a production cost becomes significantly large and inspection and maintenance require substantial period. Furthermore, due to complexity of the mechanism, and the possibility of occurrence of failure becomes relatively high.

SUMMARY OF THE INVENTION

It is an object of the present invention to provide heating means of a tower type multi-color printing press which makes heating means compact and simplified to reduce a space required for installation of the heating means, to reduce production cost, to facilitate inspection and maintenance, and to reduce frequency of occurrence of failure.

In order to accomplish the above-mentioned object, according to one aspect of the present invention, a tower type multi-color printing press comprises:

a plurality of printing sections provided with stacking in a vertical direction; and heating means provided on downstream side of each printing section and extending in a width direction of a paper web fed through a path across each printing section, for heating a printed surface of the paper web every time completing the printing in each printing section.

In the preferred construction, the tower type multi-color printing press further may comprise cooling means provided on downstream side of the heating means for cooling the printed surface, as required.

By passing the paper web through each printing section, multi-color printing is performed by each printing section. Each image printed by each printing section is individually heated by the heating means provided located on downstream side of the corresponding printing section for evaporating a solvent of the ink forming the image and/or softening and melting a thermoplastic material contained in the ink by heating to penetrate into a paper fiber. In case of the construction where the cooling means is provided on the downstream side of the heating means of each printing section, the image heated by the heating means is individually cooled to be hardened and set the thermoplastic material in the ink forming each image.

As set forth above, by implementing the present invention, in the tower type multi-color printing press, at every time of performing the printing the image by the printing section, heating is effected immediately after printing to evaporate the solvent in the ink forming the image and/or softening or melting a thermoplastic material to penetrate into the paper fiber. Accordingly, when an ink amount to be evaporated the solvent by the heating means and/or to be softened and molten the thermoplastic material into the paper fiber becomes small, the ink layer becomes thinner to be heated for a relatively short period to obtain a desired heating condition for evaporating the solvent and/or softening and melting the thermoplastic material. Thus, heating period can be short and a heating path of the paper web can be short. Namely, the heating means can be made compact and associating therewith, simplified in construction.

As a result, space saving of the heating means, lowering of production cost and facilitating of inspection and maintenance can be achieved. Also, for simplified construction of the heating means, frequency of occurrence of failure can be reduced. Also, for short period required for heating, a heat amount to be accumulated in the entire paper web becomes small. Thus, cooling means can be compact and simplified associating with compact construction. Accordingly, similar to the heating means, space saving of the cooling means, lowering of production cost and facilitating of inspection and maintenance can be achieved. Also, for simplified construction of the cooling means, frequency of occurrence of failure can be reduced.

On the other hand, in the construction of the shown embodiment where the cooling means for cooling the printed surface is provided on the downstream side of the heating means, the ink forming the image printed by each printing section can be positively cooled every time heating the ink instead of expecting the cooling effect of the dampening water in the downstream side printing section. Also, by providing each cooling means individually corresponding to each printing section, the simple and compact cooling means can be satisfactory.

It should be noted that owing to down-sizing and simplification of both the heating means and the cooling means, as the overall device stabilizing the ink, space saving, lowering of production cost and facilitating of inspection and maintenance can be achieved. Furthermore, associating with simplification, frequency of occurrence of failure can be reduced.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

In the following description, numerous specific details are set forth in order to provide a thorough understanding of the present invention. It will be obvious, however, to those skilled in the art that the present invention may be practiced without these specific details. In other instances, well-known structures are not shown in detail in order to avoid unnecessarily obscuring the present invention.

Figure 1:
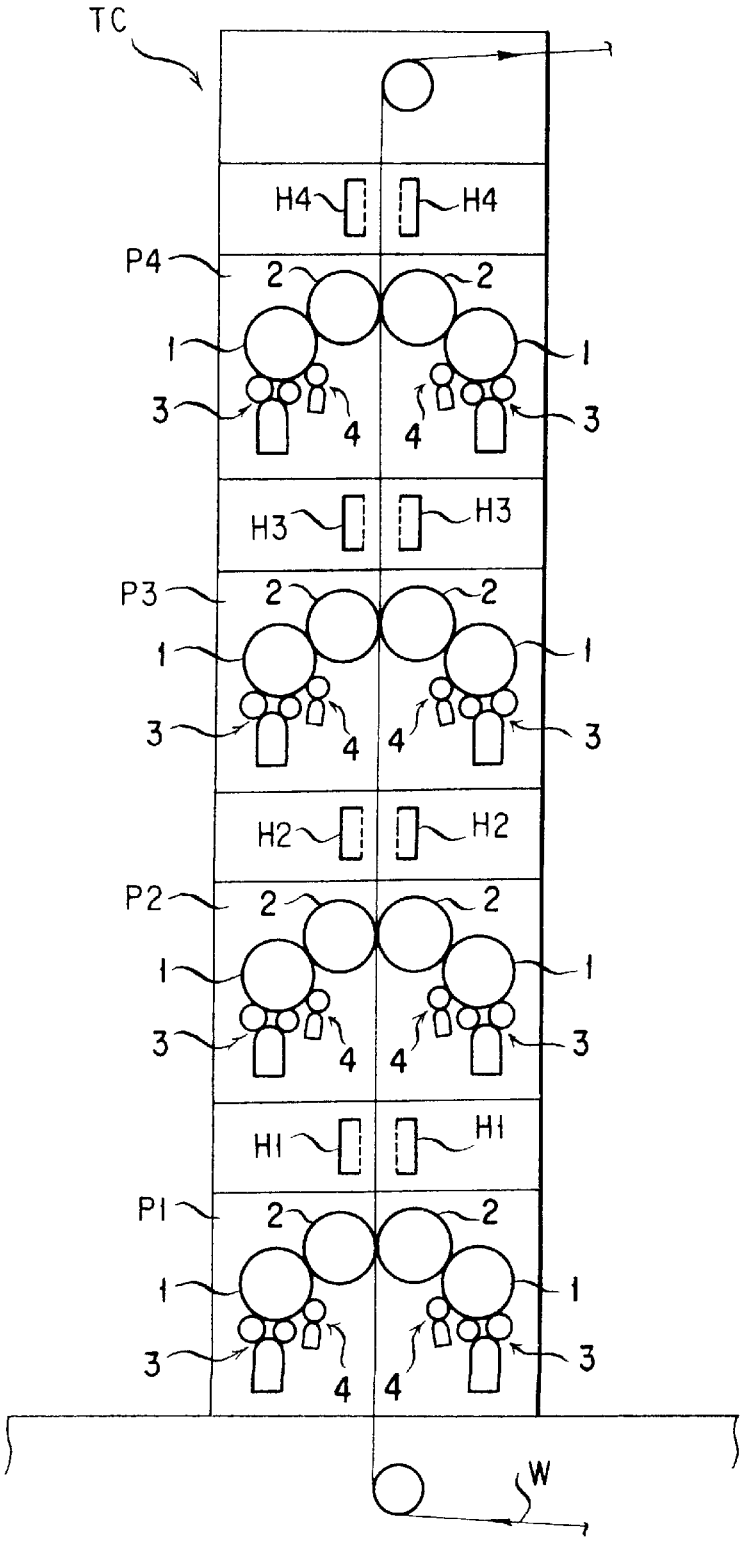
FIG. 1 is a side elevation showing an internal layout of a preferred embodiment of a tower type multi-color printing press according to the present invention.

FIG. 1 is a side elevation showing an internal layout of a preferred embodiment of a tower type multi-color printing press according to the present invention. A tower type multi-color printing press TC has four printing sections, i.e. first, second, third and fourth printing sections P1, P2, P3 and P4 stacked in a vertical direction. A paper web W is guided to pass these four printing sections P1, P2, P3 and P4 from lower side to upper side in sequential order.

On the other hand, the tower type multi-color printing press TC also includes first, second, third and fourth heating means H1, H2, H3 and H4 provided on the respective downstream sides of the respective printing sections P1, P2, P3 and P4 and opposing to a path to pass the paper web W, over the entire width of the paper web W.

The first, second, third and fourth printing sections P1, P2, P3 and P4 have blanket cylinders 2 contacting with the paper web W to perform printing on both sides of the paper web W, simultaneously, and thus constructing so-called BB (blanket-to-blanket) type offset printing sections. Namely, in each printing section, two blanket cylinders 2 respectively provided with plate cylinders 1 are located adjacent to each other across a guide path of the paper web W guided to be fed in a vertical direction. Then, these two blanket cylinders 2 contact with each other interpositioning the paper web W therebetween in a condition respectively contacted with respectively corresponding plate cylinders 1 to perform printing operation.

In each plate cylinder 1 of each printing section P1, P2, P3 and P4, an inking unit 3 and a dampening unit 4 are provided for supplying an ink and a dampening water to a plate (not shown) mounted on the peripheral surface of the plate cylinder 1. The ink and the dampening water supplied on the plate reach the paper web W via blankets (not shown) mounted on the peripheral surfaces of the blanket cylinders 2. Thus, printing is performed.

Figure 3:
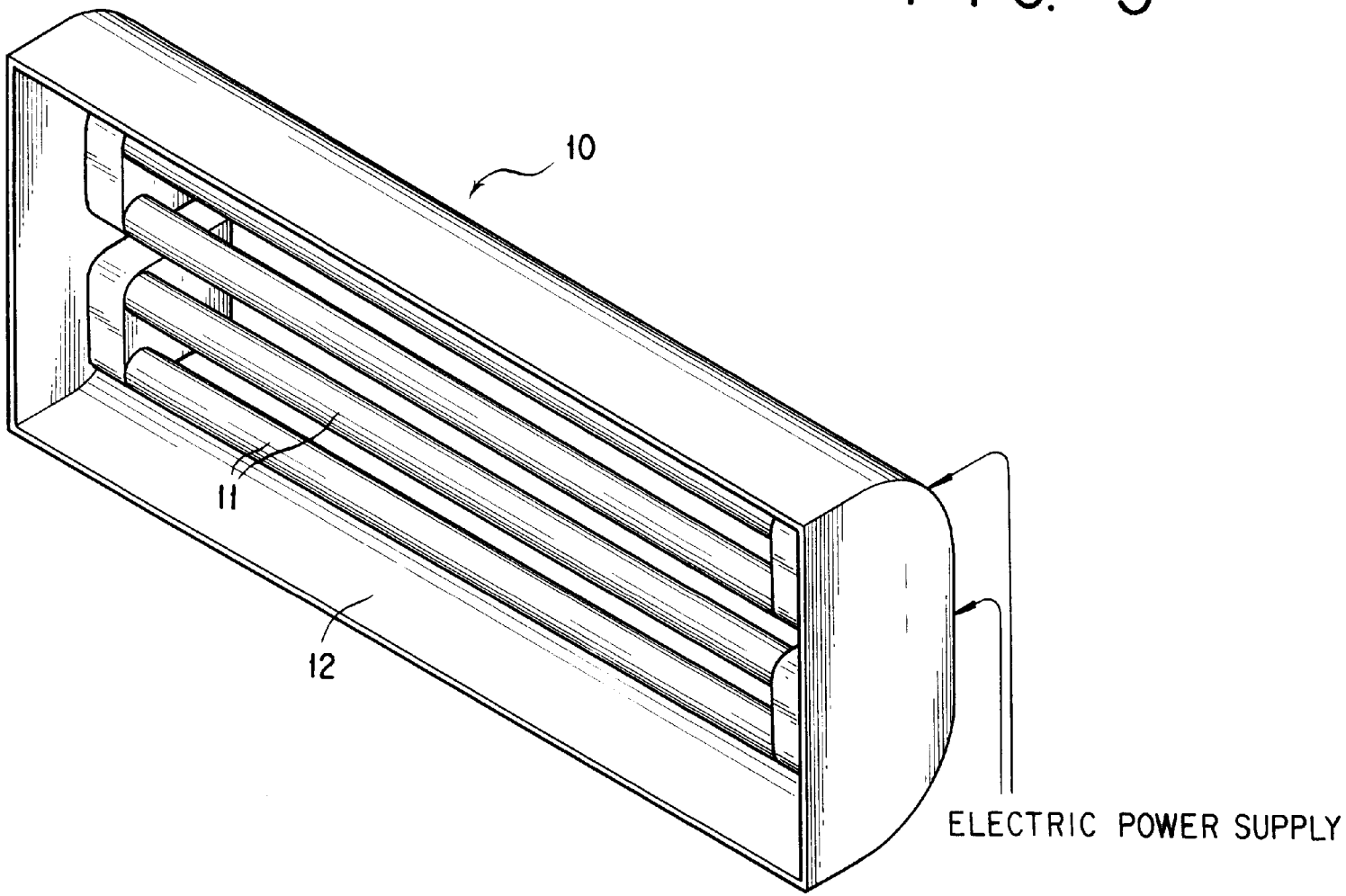
FIG. 3 is a perspective view showing an embodiment of a heating means which can be implemented in the embodiments shown in FIGS. 1 and 2.

Each of the first, second, third and fourth heating means H1, H2, H3 and H4 is an infrared ray irradiation type heating mechanism 10, in which an elongated infrared ray lamp 11 and a reflection plate 12 are combined as shown in FIG. 3, for example. A reflection surface of a reflection plate 12 is opposed to the paper web W. The elongated infrared ray lamp 11 positioned between the paper web W and the reflection plate 12 at a position inclined toward the reflection plate 12, is constructed in parallel to the width direction of the paper web W.

Figure 4:
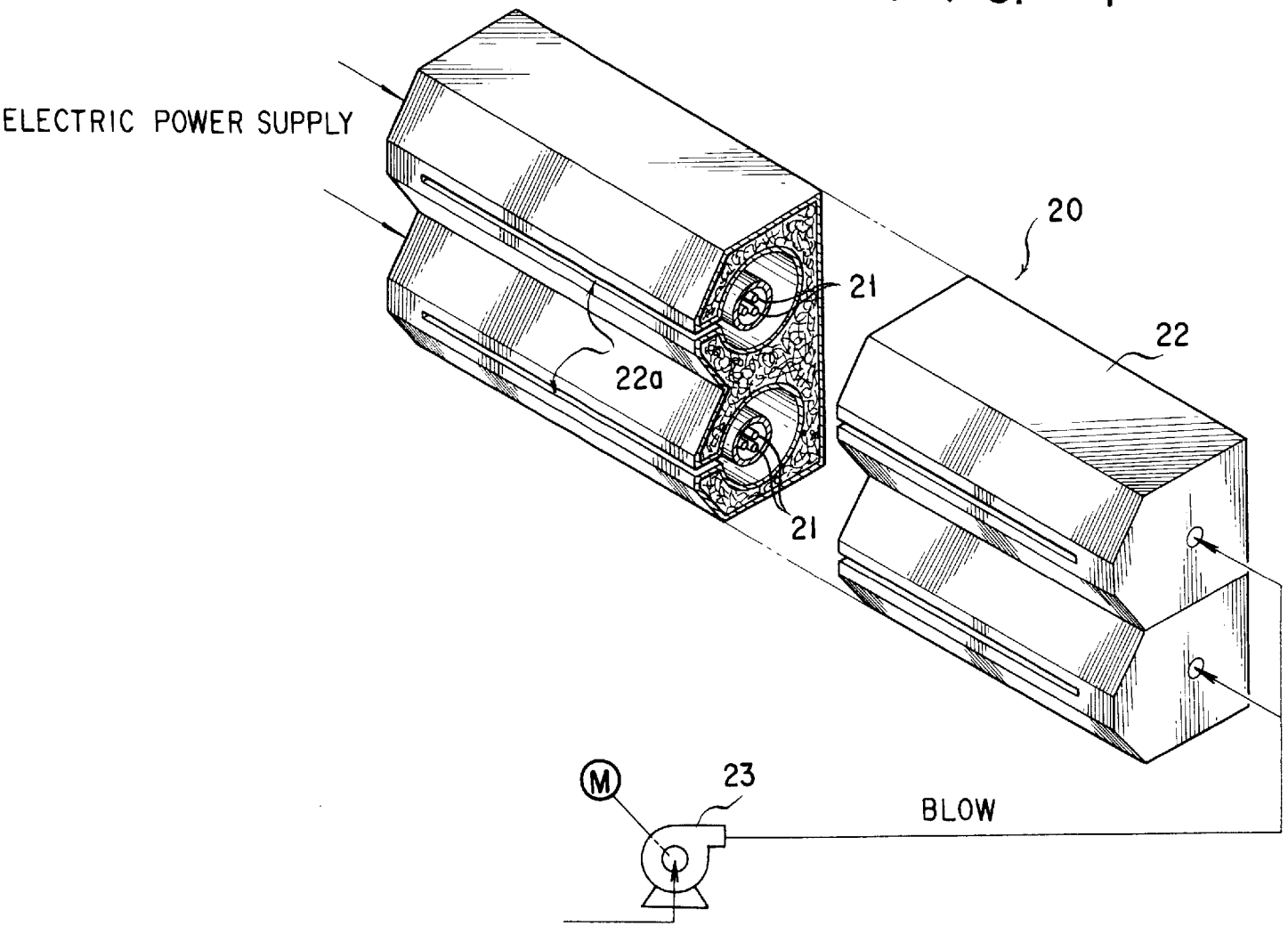
FIG. 4 is a partially cut perspective view showing another embodiment of the heating means which can be implemented in the embodiments shown in FIGS. 1 and 2 and different from the embodiment shown in FIG. 3.

In the alternative, each of the first, second, third and fourth heating means H1, H2, H3 and H4 is constructed with a hot air blowing type heating mechanism 20 which is constructed by a combination of an elongated heating box 22 having an appropriate heating portion 21 and a blowing mechanism 23 as shown in FIG. 4, for example. A slit 22*a* provided in the heating box 22 is opposed to the paper web W with an appropriate angle orienting the heating box 22 in parallel to the width direction of the paper web W.

In the further alternative, both the infrared ray irradiation type heating mechanism 10 and the hot air blowing type heating mechanism 20 may be juxtaposed (not shown) with each other relative to feeding direction of the paper web W.

Figure 2:
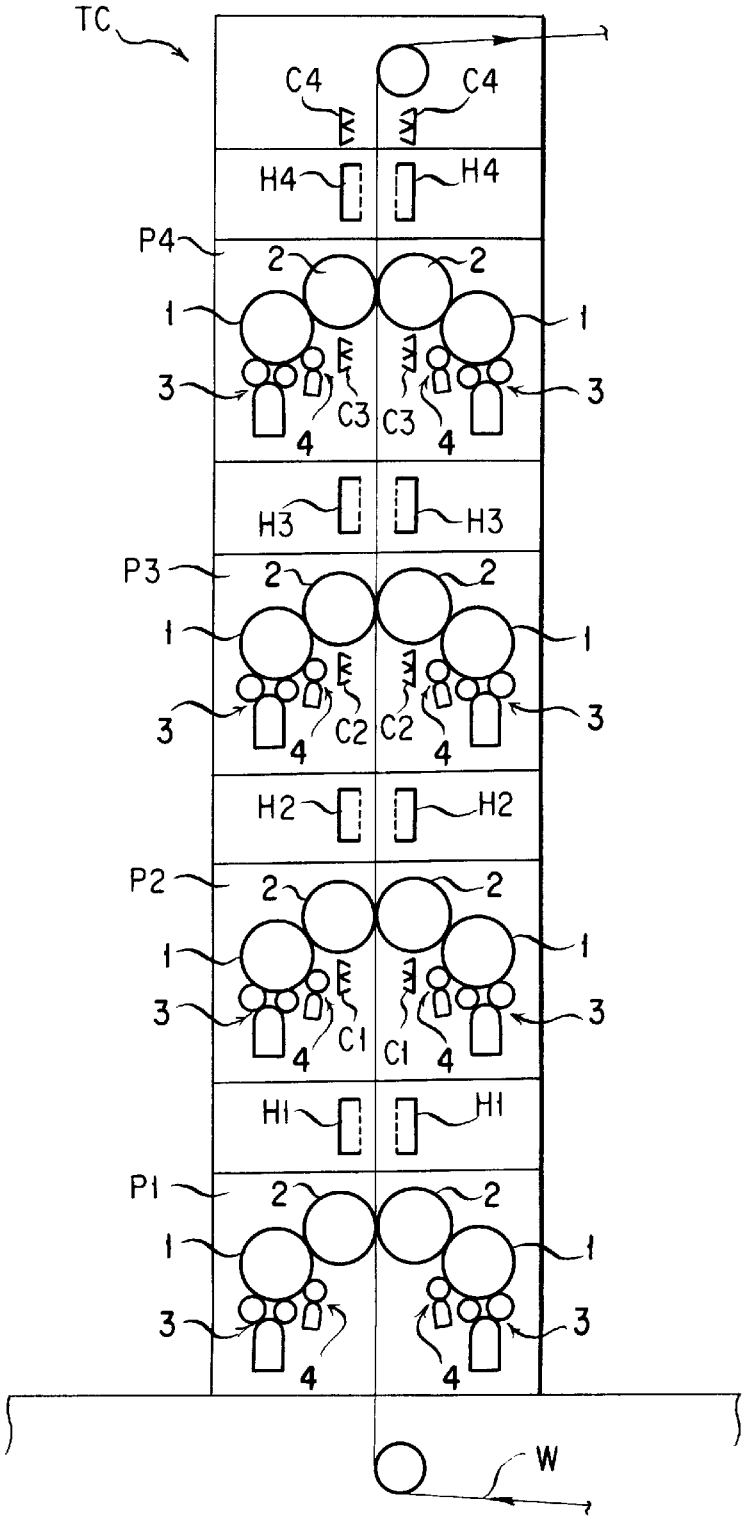
FIG. 2 is a side elevation showing an internal layout of another embodiment of the tower type multi-color printing press according to the present invention, different from the embodiment shown in FIG. 1.

On the downstream side of the first, second, third and fourth heating means H1, H2, H3 and H4, appropriate first, second, third and fourth cooling means C1, C2, C3 and C4 are provided as required, as shown in FIG. 2. Each of these cooling means C1, C2, C3 and C4 is adapted to cure the ink which is heated by each heating means H1, H2, H3 and H4 to soften the thermoplastic component of the ink and thus becomes unstable on the web W by drying. Accordingly, upon printing, for example, the solvent of the ink is evaporated by heating with the heating means H1, H2, H3 and H4, if the ink becomes stable on the paper web W and the thermoplastic component is softened by heating with the heating means H1, H2, H3 and H4 to penetrate into the paper web W to be stable thereon, the cooling means C1, C2, C3 and C4 are not necessary.

On the other hand, as will be explained later, if there is some component serving as replacement of the cooling means C1, C2, C3 and C4, the cooling means C1 C2, C3 and C4 are unnecessary.

Each of the first, second, third and fourth cooling means C1, C2, C3 and C4 is constructed with a cool air blowing type cooling mechanism 30 comprising an elongated cooling box 32 having an appropriate coolant flow path portion 31 and a blower mechanism 33 as shown in FIG. 33, for example. A slit 32*a* provided in the cooling box 32 is opposed in opposition to the paper web W with an appropriate angle relative to the paper web W. The cooling box 32 is oriented in parallel to the width direction of the paper web W. The respective first, second and third cooling means C1, C2 and C3 are positioned in the vicinity of the respective two blanket cylinders 2 of the printing sections P2, P3 and P4 located downstream side of the respective first, second and third heating means H1, H2 and H3. The uppermost cooling means C4 is located at an appropriate position on the downstream side of the uppermost heating means H4.

Next, operation and effect of the shown embodiment constructed as set forth above will be discussed hereinafter. Associating with initiation of printing operation or in advance of initiation of printing operation, the heating means or in case that the cooling means is also provided, the heating means and the cooling means are actuated.

At first, discussion will be given for the tower type multi-color printing press TC employing only heating means as shown in FIG. 1. Printing operation is initiated and the paper web W is fed and the respective images are printed on both surfaces of the paper web W by the respective first, second, third and fourth printing sections P1, P2, P3 and P4. Also, the paper web W passes through the respective first, second, third and fourth heating means H1, H2, H3 and H4 provided on downstream side of the respective printing sections P1, P2, P3 and P4.

Accordingly, the image printed in each printing section P1, P2, P3 and P4 is heating in advance of being fed into the next printing section. Then, the solvent of the ink forming the printed image is evaporated immediately after printing by the corresponding printing section and/or the thermoplastic material of the ink is softened and molten to increase flowability to be penetrated into paper fiber and then dried. At this time, heating of the paper web W by the respective heating means H1, H2, H3 and H4 is performed to sufficiently elevate the temperature of the paper web surface for evaporating the solvent of the ink forming the image printed by one printing section and for softening and melting the thermoplastic material of the ink. The temperature is in a range of 90° C. to 200° C.

When the heating means H1, H2, H3 and H4 is the infrared ray irradiating type heating mechanism 10 shown in FIG. 3, an electric power is supplied to the infrared ray lamp 11 for generating the infrared ray. The infrared ray thus generated is directly irradiated or reflected by the reflection plate 12 to be irradiated to the paper web W for heating the latter.

On the other hand, when the heating means H1, H2, H3 and H4 is the hot air blowing type heating mechanism 20 as shown in FIG. 4, an appropriate energy is supplied to a heat generating portion 21 provided in the heating box 22. For example, when the heating generating portion 21 is an electric heating type, an electric power is supplied to the heat generating portion 21. Also, within the heating box 22, in which the heating generating portion 21 is heated, an air is blown by the blower mechanism 23. Then, the air is heated by the heat generating portion 21 to be blown as a hot air through the slit 22*a* of the heating box 22 to heat the paper web W by this hot air.

On the other hand, when the heating means H1, H2, H3 and H4 is constructed by combination of the infrared ray irradiating type heating mechanism 10 and the hot air blowing type heating mechanism 20, operations of both mechanisms are performed to attain the effects of both mechanisms.

In the embodiment shown in FIG. 1, the solvents of the inks forming the image printed by the respective printing sections P1, P2, P3 and P4 are heated and evaporated individually by the heating means H1, H2, H3 and H4. Certain kind of inks forming the image is half softened the thermoplastic component contained in the ink not to lower viscosity thereof and thus not to penetrate into the paper fiber to be unstable on the paper web W to possibly deposit or stain other substances.

However, in this embodiment, the printing sections P1, P2, P3 and P4 are provided with the dampening units 4 respectively to constantly transfer the dampening water to the blanket cylinders 2 via the plate cylinders 1 for printing by the first, second and third printing sections P1, P2 and P3. The image individually heated on the downstream side respectively is appropriately and abruptly cooled by the dampening water on the peripheral surface of the blanket cylinders 2 upon passing through the downstream side printing sections, namely the second, third and fourth printing sections P2, P3 and P4.

As a result, the images printed by the first, second and third printing sections P1, P2 and P3 except for the fourth printing section P4 located on the most downstream side, are individually heated by the heating means and cooled by respective printing sections. Thus, the solvent of the ink forming the image is evaporated and cooled to be cured.

Figure 5:
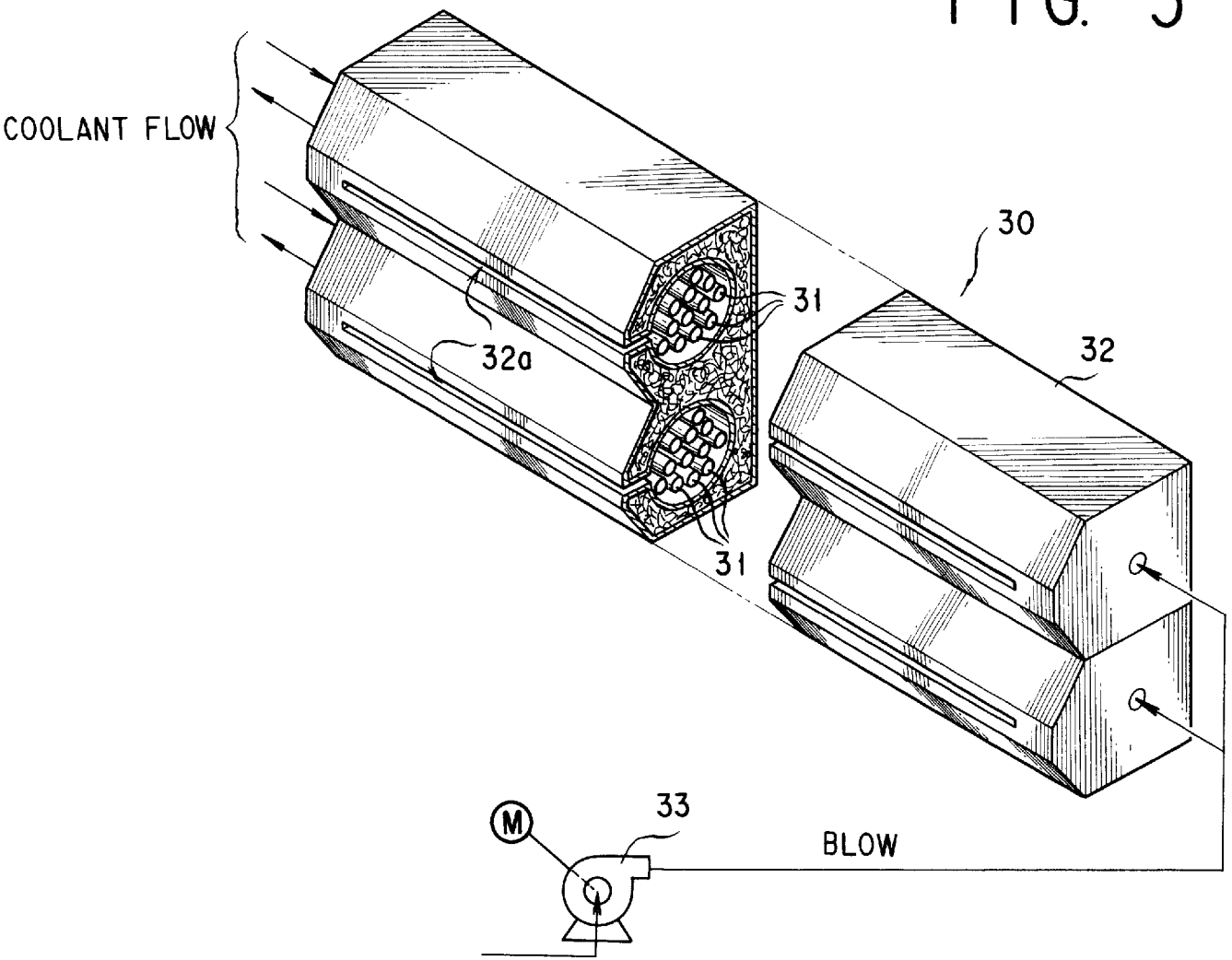
FIG. 5 is a perspective view showing an embodiment of a cooling means which can be implemented in the embodiments shown in FIGS. 1 and 2.
Figure 6:
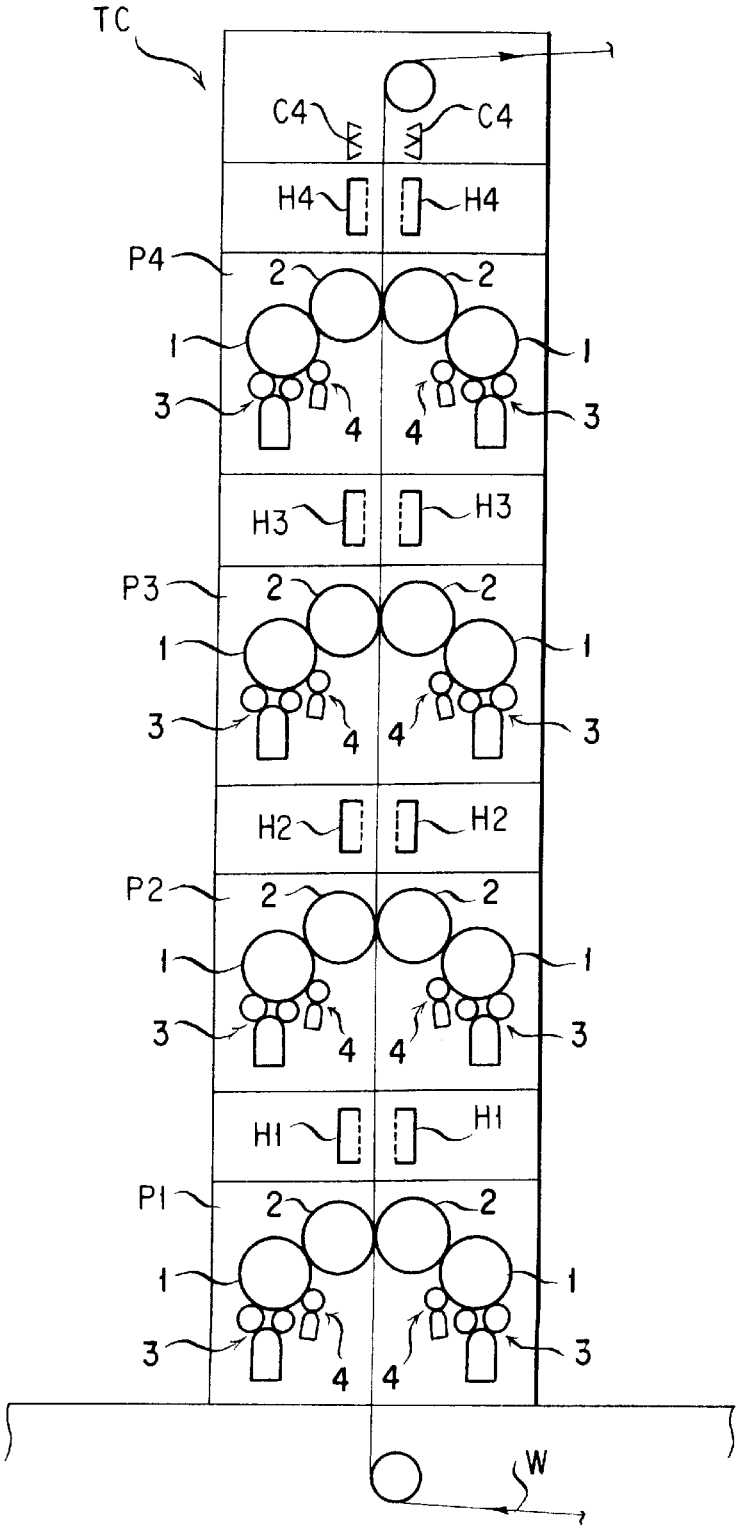
FIG. 6 is a side elevation showing an internal layout of a further embodiment of the tower type multi-color printing press according to the present invention, different from the embodiment shown in FIGS. 1 and 2.

At this time, the image printed by the fourth printing section P4 on the most downstream side cannot pass other printing sections and thus cannot be cooled by the dampening water of the printing section. Therefore, as shown in FIG. 6, the cooling means C4 shown in FIG. 5 are provided on both sides of the path of the paper web W on the downstream side of the printing section P4 for cooling.

Next, discussion will be given for the tower type multi-color printing press TC employing the heating means and the cooling means as shown in FIG. 2. In the shown embodiment, instead of expecting the cooling effect of the dampening water in the printing section on the downstream side as in the embodiment shown in FIG. 1, the image printed by each printing section is positively cooled by the cooling means every time heating the ink.

Namely, the image printed in each printing section P1, P2, P3 and P4 is heated by the heating means before passing through another printing portion to evaporate the solvent contained in the ink for forming each image and then cooled by the cooling means.

Accordingly, when the solvent is evaporated by heating the ink forming the image, if the thermoplastic component contained in the ink is half softened, the viscosity of the thermoplastic component as half softened by heating can be lowered by hardening as cooled by the cooling means and thus set so as not to deposit or stain on other substances.

At this time, cooling the paper web W by the respective cooling means C1, C2, C3 and C4 is performed to sufficiently cool the thermoplastic component of the ink forming the image down to the temperature of the paper web surface for setting the thermoplastic component. Namely, the thermoplastic component is cooled to be lower than or equal to about 30° C.

On the other hand, when each cooling means C1 C2, C3 and C4 is the cool air blowing type cooling mechanism as shown in FIG. 5, a cool water, for example, passes through the coolant flow path portion 31 provided in the cooling box 32. Also, within the cooling box 32 passed through the cooling water in the coolant flow path portion 31, air is blown by the blower mechanism 33 to be cooled by the coolant flow path portion 31. Then, the cool air is blown through the slit 32*a* of the cooling box 32 to cool the paper web W by the cool air.

Although the invention has been illustrated and described with respect to the exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A tower type multi-color printing press comprising:

a plurality of vertically stacked printing sections, each configured to print a paper web fed therethrough along a printing path formed by the plurality of printing sections by supplying an ink and a dampening water via a blanket, wherein the printing path has an upstream direction and a downstream direction and the paper web is fed from the bottom to the top of the printing press;

a plurality of heating means for heating a printed surface of the paper web, each configured to extend in a transverse direction of the paper web, wherein the number of heating means corresponds to the number of printing sections, a heating means is provided on the downstream side of each of the plurality of printing sections and is configured to heat the printed surface of the paper web after passing through the printing section upstream therefrom, and a cooling means for cooling the printed surface of the paper web, wherein the cooling means is provided only on the downstream side of an ultimate heating means and is configured to cool the printed surface of the paper web after passing the ultimate heating means;

wherein the heating means is adapted to heat a printed image on the paper web after passing through each of the printing sections to evaporate a solvent of the ink and soften the ink, the dampening water supplied to each of the printing sections on the downstream side of each of the heating means is adapted to cool the ink softened by the heating with each of the heating means and the cooling means is adapted to cool the ink softened by the heating with the ultimate heating means, to cure the ink to be stable on the paper web.

* * * * *

UNITED STATES PATENT AND TRADEMARK OFFICE

CERTIFICATE OF CORRECTION

PATENT NO. : 6,178,883 B1
DATED : January 30, 2001
INVENTOR(S) : Masayoshi Satoh et al.

It is certified that error appears in the above-identified patent and that said Letters Patent is hereby corrected as shown below:

Item (73) Change "Kabushiki Kaisha Tokyo Kikai" to --Kabushiki Kaisha Tokyo Kikai Seisakusho--

Signed and Sealed this

Third Day of July, 2001

*Attest:*

Nicholas P. Godici

*Attesting Officer*

NICHOLAS P. GODICI
*Acting Director of the United States Patent and Trademark Office*